US006450624B1

(12) United States Patent
De Roos et al.

(10) Patent No.: US 6,450,624 B1
(45) Date of Patent: Sep. 17, 2002

(54) INK JET PRINTER

(75) Inventors: Mike De Roos, Kungsängen; Christer Boström, Åkersberga, both of (SE)

(73) Assignee: XaarJet AB, Jarfalla (SE)

( * ) Notice: Subject to any disclaimer, the term of this patent is extended or adjusted under 35 U.S.C. 154(b) by 0 days.

(21) Appl. No.: 09/530,148

(22) PCT Filed: Oct. 30, 1998

(86) PCT No.: PCT/SE98/01972

§ 371 (c)(1),
(2), (4) Date: Jul. 21, 2000

(87) PCT Pub. No.: WO99/22939

PCT Pub. Date: May 14, 1999

(30) Foreign Application Priority Data

Oct. 30, 1997 (SE) ..... 9703983
Jun. 16, 1998 (SE) ..... 9802142

(51) Int. Cl.[7] ..... B41J 2/045; B41J 2/05
(52) U.S. Cl. ..... 347/68; 347/57
(58) Field of Search ..... 347/13, 257, 58, 347/57, 59; 358/298

(56) References Cited

U.S. PATENT DOCUMENTS 4,689,694 A * 8/1987 Yoshida ..... 347/13

FOREIGN PATENT DOCUMENTS

| | | |
|---|---|---|
| EP | 0 605 216 | 12/1993 |
| EP | 0 778 132 | 12/1996 |
| EP | 0 788 822 | 1/1997 |
| WO | WO 94/26522 | 11/1994 |

OTHER PUBLICATIONS

International Search Report, PCT/US94/05064, International Publication No. WO 94/26522.

International Preliminary Examination Report in PCT/SE98/01972 dated Jan. 24, 2001.

* cited by examiner

*Primary Examiner*—Thinh Nguyen
(74) *Attorney, Agent, or Firm*—Marshall, Gerstein & Borun.

(57) ABSTRACT

The invention relates to a droplet deposition apparatus comprising an actuator (100) having a plurality of spaced piezoelectric walls defining channels, said walls having opposed sides; said opposed sides being provided with electrodes being adapted to receive electric signals to deform said walls to cause liquid in said channels to be ejected therefrom; said signals having wave forms; and a control unit (130) for defining the wave forms of said electric signals; wherein the control unit comprises means (500, 514) for providing an individually adapted signal slope of the wave form to selected electrodes (E) so as to compensate for individual channel deviations.

9 Claims, 11 Drawing Sheets

INK JET PRINTER

TECHNICAL FIELD OF THE INVENTION

The present invention relates to a droplet deposition apparatus including an actuator, and to a control circuit for an actuator.

DESCRIPTION OF RELATED ART

Ink jet printers include an ink actuator for ejecting droplets of ink liquid on demand. Such an ink actuator is disclosed in U.S. Pat. No. 5,016,028. The actuator includes a plurality of channels having side walls which are displaceable in response to electric drive signals. When an electric drive signal is applied to a section of the wall, the wall will move, thereby causing the volume of corresponding channels to increase or decrease.

U.S. Pat. No. 5,631,675 describes an apparatus for driving piezoelectric units of an ink jet recording head. The apparatus according to U.S. Pat. No. 5,631,675 includes two constant current sources which operate to charge and discharge a capacitor. The voltage of the capacitor is amplified to provide the voltage for driving the piezoelectric units.

EP 0 778 132 discloses a head driving device including an ink jet head having a number of ink chambers arranged side by side and separated by piezo-electric elements and Field effect Transistors for connecting electrodes of the ink chambers to a +VCC power source line, and to a −VCC power source line, respectively, and bi-directionakl switches for connecting the electrodes to a ground line.

SUMMARY

A problem to which the present invention is directed is to improve print performance and to further increase the yield in the manufacture of droplet deposition apparatuses.

This problem is addressed by a droplet deposition apparatus comprising an actuator having a plurality of spaced piezoelectric walls defining channels, said walls having opposed sides; said opposed sides being provided with electrodes being adapted to receive electric signals to deform said walls to cause liquid in said channels to be ejected therefrom; said signals having wave-forms; and a control unit comprising means for providing an individually adapted signal slope of the wave form to selected electrodes. Moreover, the signal slope control means includes a plurality of current signal sources having at least two individually activatable current sources for one actuator channel so as to enable provision of an individually adapted signal slope of the wave form to a selected electrode; and the control unit comprises a power supply input for receiving a controlled voltage level.

This solution makes it possible to obtain at least two different slopes of the output signal so as to compensate for individual channel deviations.

The signal slope control means may include means for setting compensation data so as to adapt the signal slope of the wave form for an individual channel deviation. In this manner each channel of an actuator may be adjusted and set to a selected liquid droplet ejection speed.

According to a preferred embodiment the droplet deposition apparatus includes means for setting a selected uniform droplet velocity of ejected droplets. This may be achieved by adjusting a maximum drive voltage level to a selected value, and by setting a maximum drive current for each channel so as to obtain a selected droplet velocity for each channel. In this manner there is ensured a uniform response to print orders and the deviation between different droplet deposition apparatuses as well as the deviation between channels is minimized or eliminated.

DETAILED DESCRIPTION OF EMBODIMENTS

Figure 1:
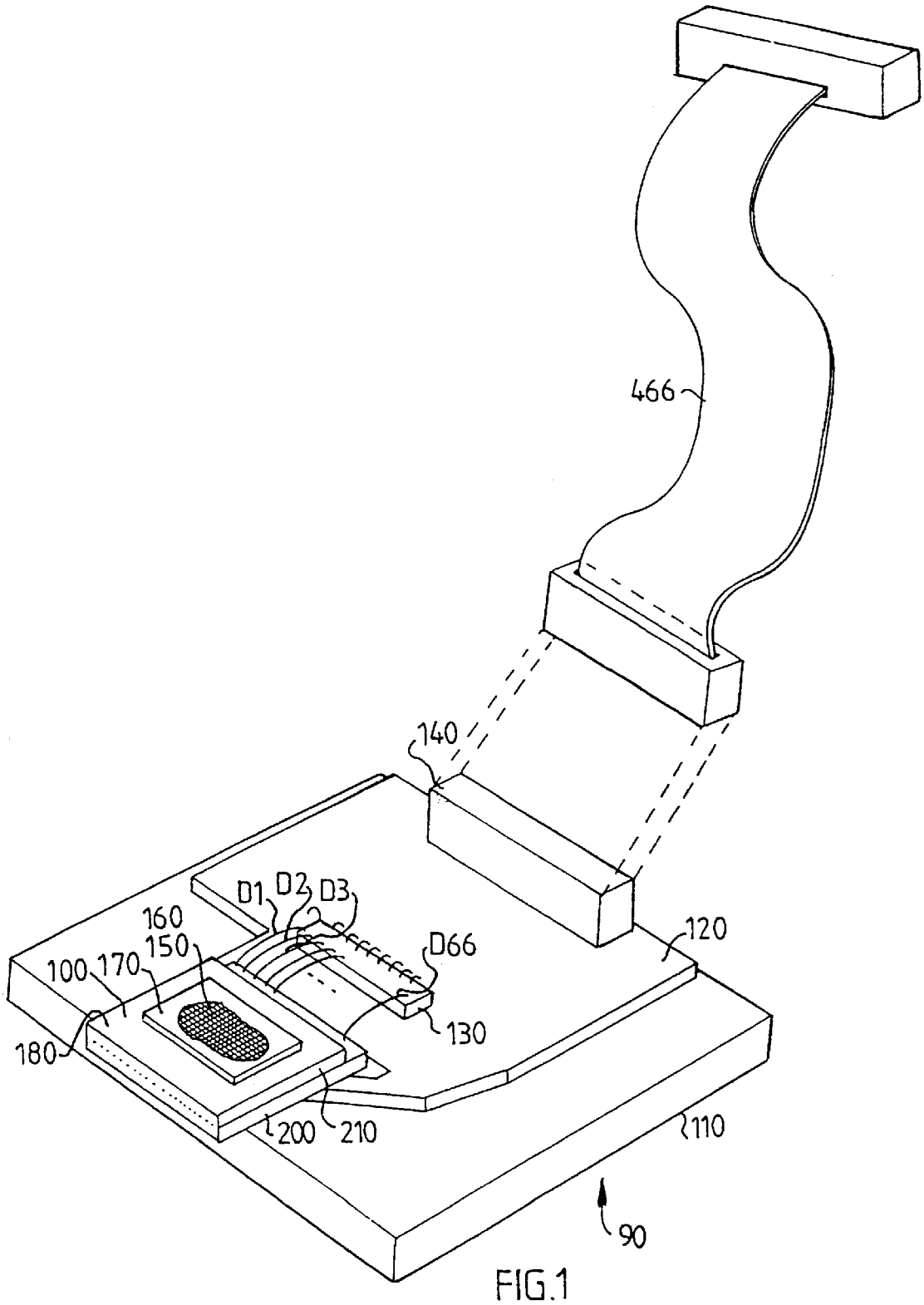
FIG. 1 is a perspective view of a print head arrangement including an actuator and a control unit coupled, via a cable, to a power supply and a data interface .

FIG. 1 is a perspective view of a print head arrangement 90 including an ink actuator 100 mounted on a base plate 110. The base plate may be arranged on a shuttle in an ink jet printer (not shown).

A circuit board 120 is also mounted on the base plate 110. The circuit board 120 includes a control unit 130 and a connector 140.

A central data processing unit in the printer or in a facsimile machine can be connected to the connector 140 and can supply print orders to the connector 140. The print orders thus supplied to the print head arrangement 90 are fed to the control unit 130. The control unit 130 transforms the print orders into electric pulses adapted to cause the actuator assembly 100 to eject ink drops in accordance with the print orders.

Ink is supplied from an ink reservoir (not shown) to an ink inlet 150 on the actuator assembly 100. The ink inlet 150 may include a filter 160. The ink inlet 150 also includes a sealing unit 170. The sealing unit 170 may include a rubber strip projecting a few tenths of a millimeter above a surface 160 of the actuator assembly 100, as shown in FIG. 1, in order to provide a tight seal when pressed towards a corresponding ink duct connector.

The actuator 100 comprises an actuator plate 200 and a cover plate 210. The actuator plate 200 is made from polarised piezoelectric material. The cover plate, which includes the ink inlet 150, is made from piezoelectric material which is not polarised.

Figure 2:
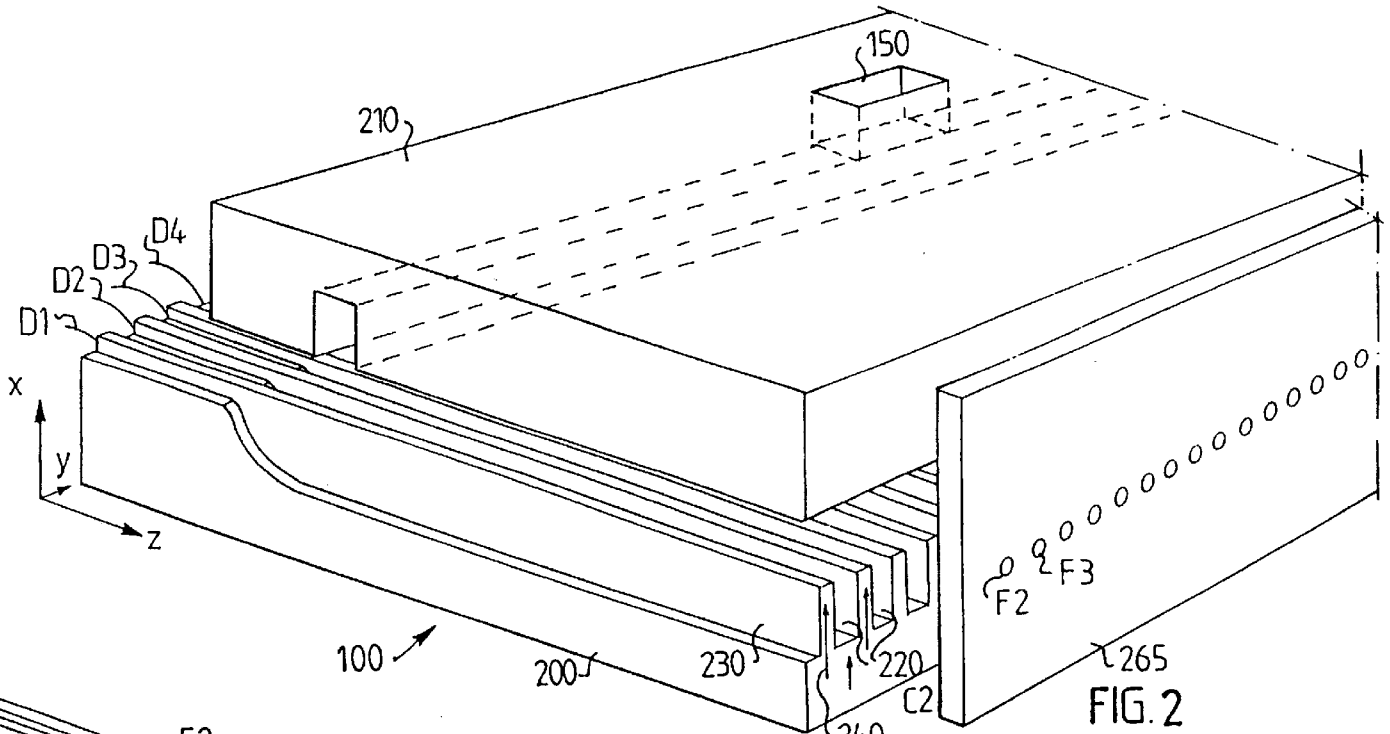
FIG. 2 is an exploded partly diagrammatic perspective view of a part of the actuator shown in FIG. 1.

FIG. 2 is an exploded partly diagrammatic perspective view of a part of the actuator 100.

The actuator plate 200 includes grooves of a rectangular cross-section forming channels 220. The channels 220 are separated by side walls 230. The whole actuator plate is poled in a direction parallel to the Z-axis in FIG. 2. The direction of polarisation is also illustrated by arrows 240 in FIG. 2.

Figure 3:
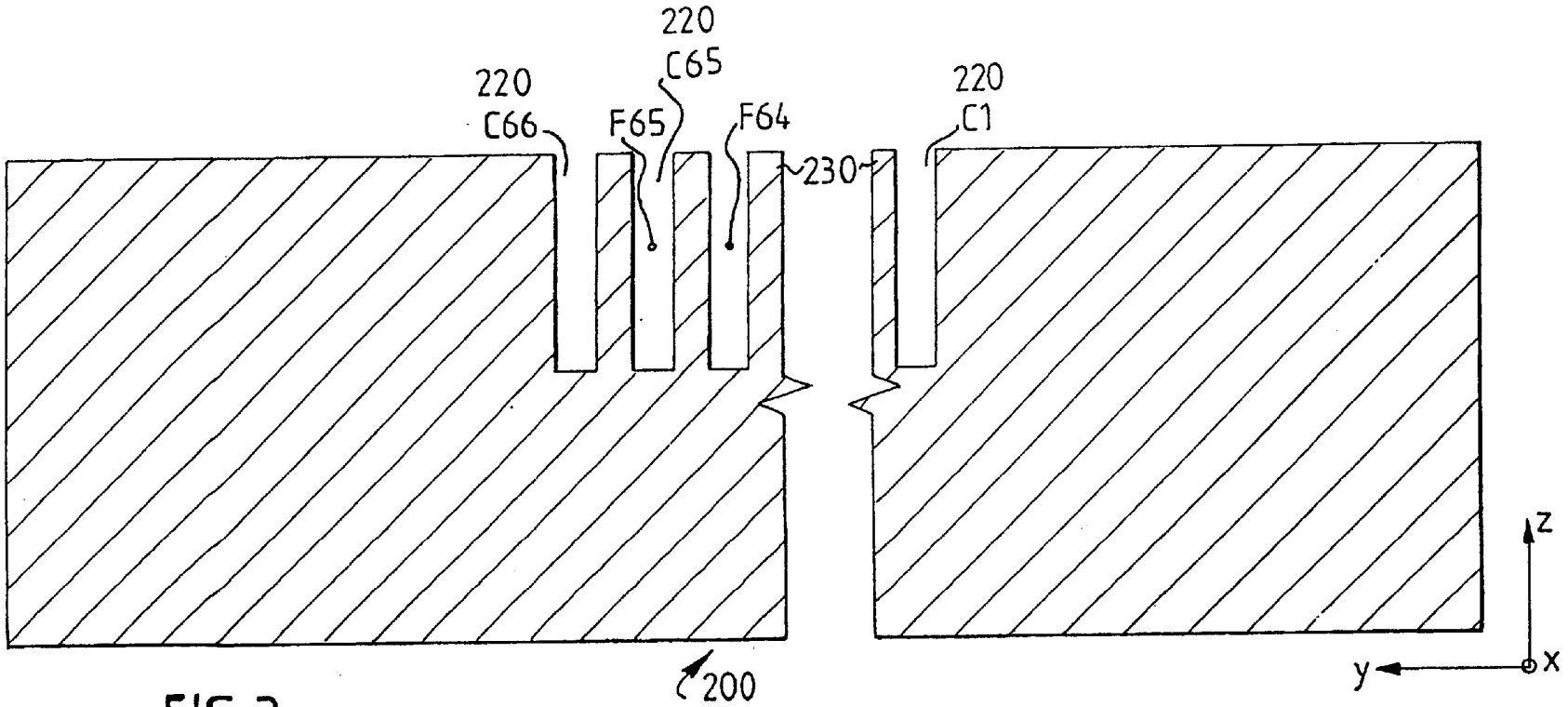
FIG. 3 is a sectional view of an actuator plate.

FIG. 3 is a sectional view of the actuator plate 200, as seen in the direction of the axis X.

According to one embodiment of the actuator assembly there are sixty-six channels 220. For easy reference the channels are individually referenced C1, C2, C3 . . . C66. Sixty-four (64) out of the 66 channels are active while two channels C1 and C66 are inactive and not used for expelling ink drops, as described in more detail below. The two inactive channels C1 and C66 are the first and the last channels as seen in the direction of the axis y in FIG. 2 or in FIG. 3.

Certain parts of the walls 230 are arranged to move in shear mode in relation to the ink channels 220 when activated by an electric field applied in a direction perpendicular to the direction of polarisation 240 of the wall 230. The side walls 230 are displaceable transversely relative to the channel axis to cause changes of pressure in the ink in the channels to effect droplet ejection from nozzles F2–F65 in a nozzle plate 265. The plate 265 is positioned in front of the open ends of the channels 220, and is provided with nozzle openings for ink droplet ejection.

Electrical connections D1, D2, D3 . . . D66 for activating the channel side walls 230 are made to the control unit by bond wires as illustrated in FIGS. 1, 2 and 4.

Figure 4:
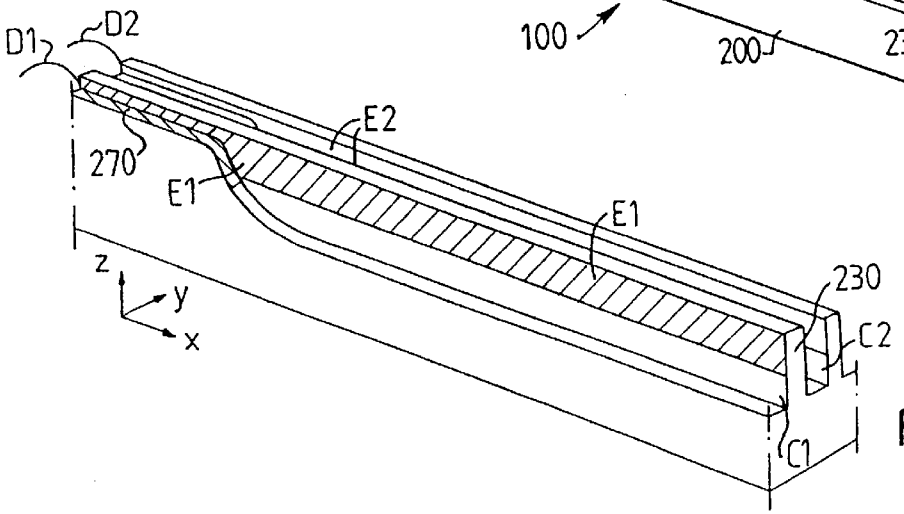
FIG. 4 is a sectional perspective view of a part of the actuator plate shown in FIG. 3.

FIG. 4 is a sectional perspective view of a part of the actuator plate 200. The bond wire D1 connects to a thin metal layer 270 (illustrated by dashed lines) arranged on a surface of the actuator plate 200. The metal layer also covers a part of the surface of the wall 230 facing towards channel C1 of the wall 230 as illustrated by the shaded area E1 in FIG. 4. Another bond wire D2 connects to metal layers E2 in channel C2 in the same manner. The metal layers E2 form electrodes on the surfaces facing channel C2 of the walls 230. The cover plate 210 is cemented onto the actuator plate 220 so as to define, together with the walls 230, channels 220 with nozzles F2, F3 . . . F65.

Figure 5A:
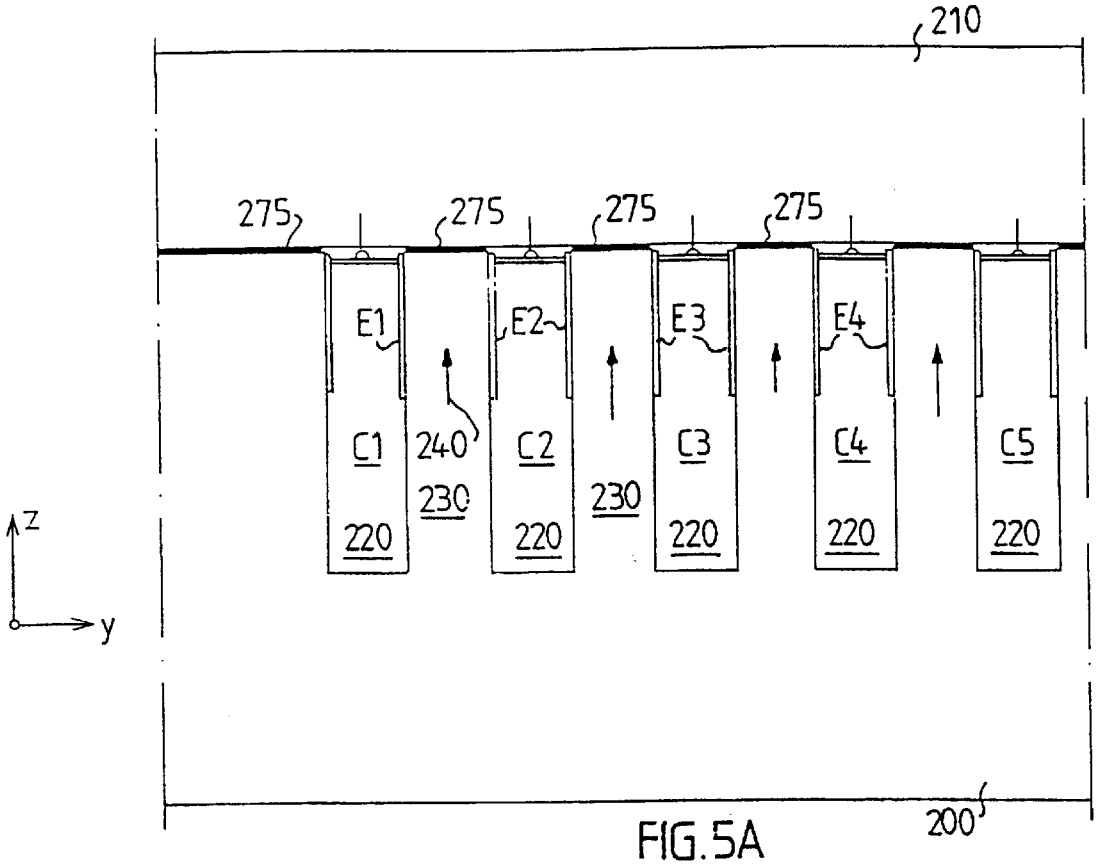
FIG. 5A is a cross-section of a part of the actuator shown in FIGS. 1 and 2 shown in a relaxed state.

FIG. 5A is a cross-section of a part of the actuator assembly 100 as seen from the nozzle plate 265. In order to simplify understanding. the three axes x, y and z are shown in FIGS. 2, 3, 4 and 5. Reference numeral 275 indicates the joint where the cover plate 210 is cemented to each wall 230 comprised in the actuator plate 200. Thus, each wall 230 is firmly attached to the cover plate.

The channels C2, C3 . . . C65 can be activated individually as described above. As described above, the channel C1 on the far left edge, as seen in FIG. 2, is an inactive channel. The channel C66 on the far right edge is also an inactive channel, i.e. it is not used for ejecting ink.

Figure 5B:
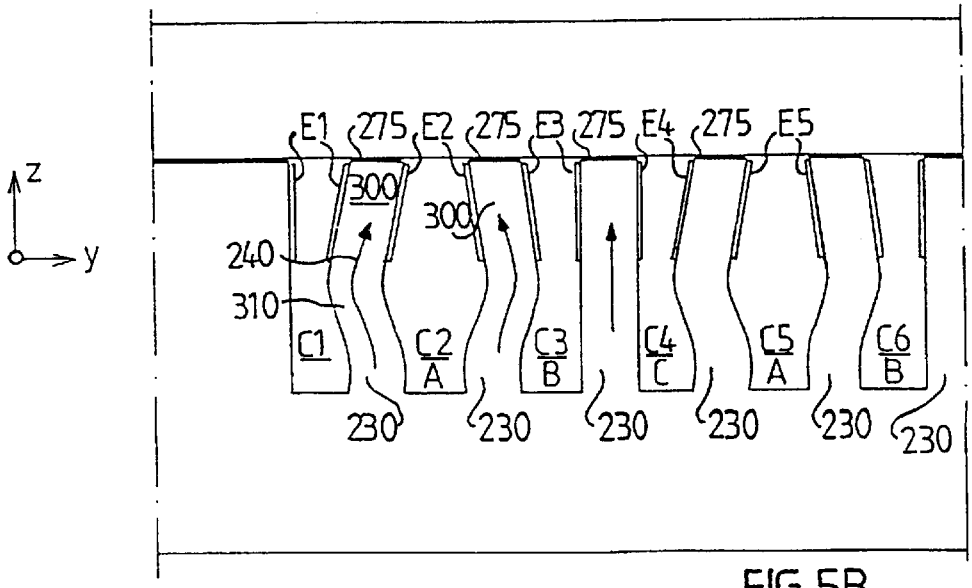
FIG. 5B is a cross-section of a part of the actuator shown in FIGS. 1 and 2 with some channels shown in an expanded state

FIG. 5B illustrates channel C2 in an expanded state. The expansion is achieved by causing a current to flow from the electrodes E2 to the electrodes E1 and E3. Due to the impedance between the E2 and the electrode E1 there will be a potential $U_{21}$ between the electrode E2 and the electrode E1.

An electric field is thereby caused in a portion 300 in the wall 230 between the electrode E2 and the electrode E1 in a direction substantially perpendicular to the direction of polarisation 240. This causes the portion 300 of the wall to flex in a shear mode to the position shown in FIG. 5B. When the wall part 300 flexes, it also forces the complementary part 310 of the wall to bend in the same direction.

When channel C2 expands, it draws in more ink through the ink inlet 150 (best seen in FIG. 2).

Figure 6:
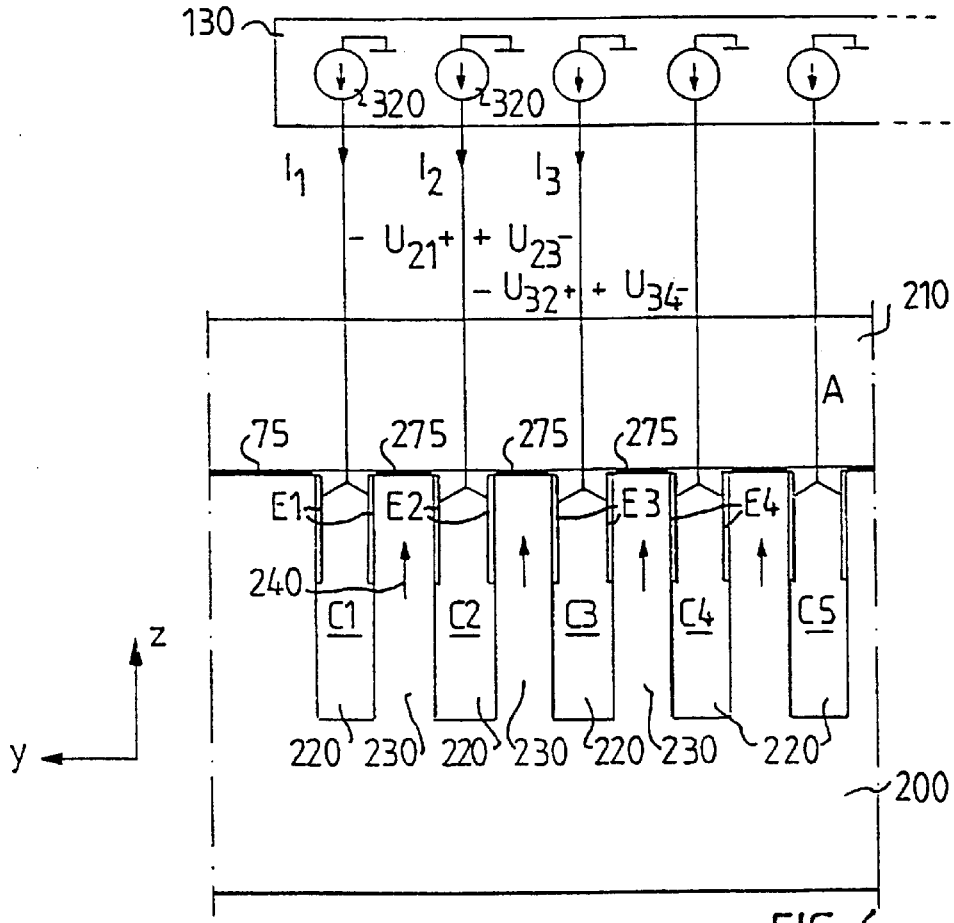
FIG. 6 is a partly schematic view showing electrode connections from an electrical point of view.

FIG. 6 is a partly schematic view showing the electrode connections from an electrical point of view.

The electrodes E1 in channel C1 are connected to the control unit 130 as shown in FIG. 6.

The control unit comprises a drive signal source 320 for each channel. There is thus one drive signal source 320 for each channel C1–C66. Each drive signal source 320 is coupled to the electrodes E in the corresponding channel, as illustrated in FIG. 6.

Each wall 230 is individually displaceable in dependence on the current between the electrodes on that wall. For example, the wall between channel C2 and channel C3 is displaceable in dependence on a current $I_{23}$ from electrode E2 to electrode E3.

Figure 7:
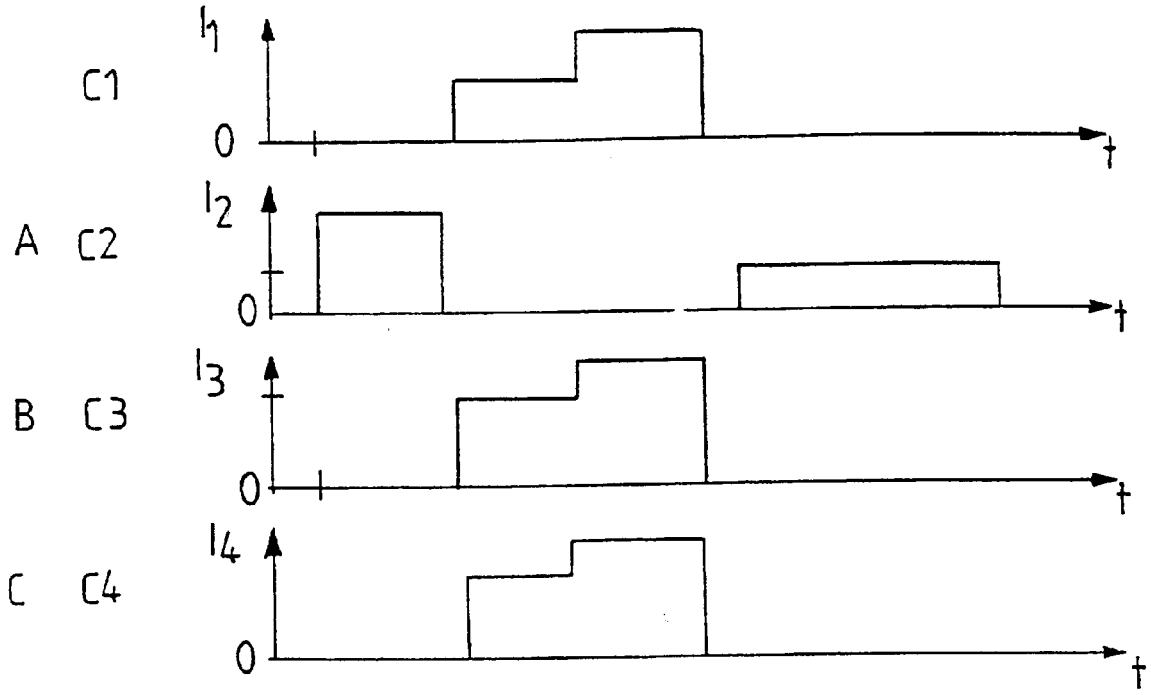
FIG. 7 illustrates an example of electric signal wave forms at the electrode connections when a maximal number of ink droplets is to be ejected.

FIG. 7 illustrates examples of electric pulses I1–I6 delivered to the electrodes E1–E6 when a maximal number of ink droplets are to be ejected.

Figure 8:
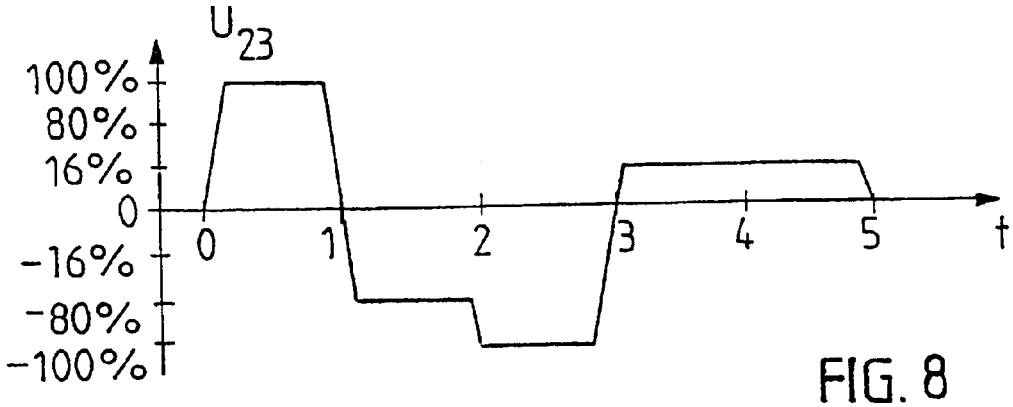
FIG. 8 illustrates an example of an electric signal wave form relating to one wall having two opposing sides with electrodes.

FIG. 8 illustrates an example of an electric signal wave form relating to the two opposing electrodes E2 and E3 on the wall between channel C2 and channel C3.

Certain essential properties of the ink, such as viscosity, change in dependence on ink temperature. In order to compensate for this temperature dependency, the temperature of the actuator assembly is measured by a temperature sensor 470 (FIG.9) and the voltage levels in the pulse wave forms are decreased with rising ink temperature. According to an embodiment of the invention the voltage top value $V_{cc(100)}$ is set to 35 volts when the actuator temperature is 20° C. The voltage top value is herein referred to as the 100% voltage level. According to an embodimenet of the invention the temperature sensor is a thermistor.

Figure 9:
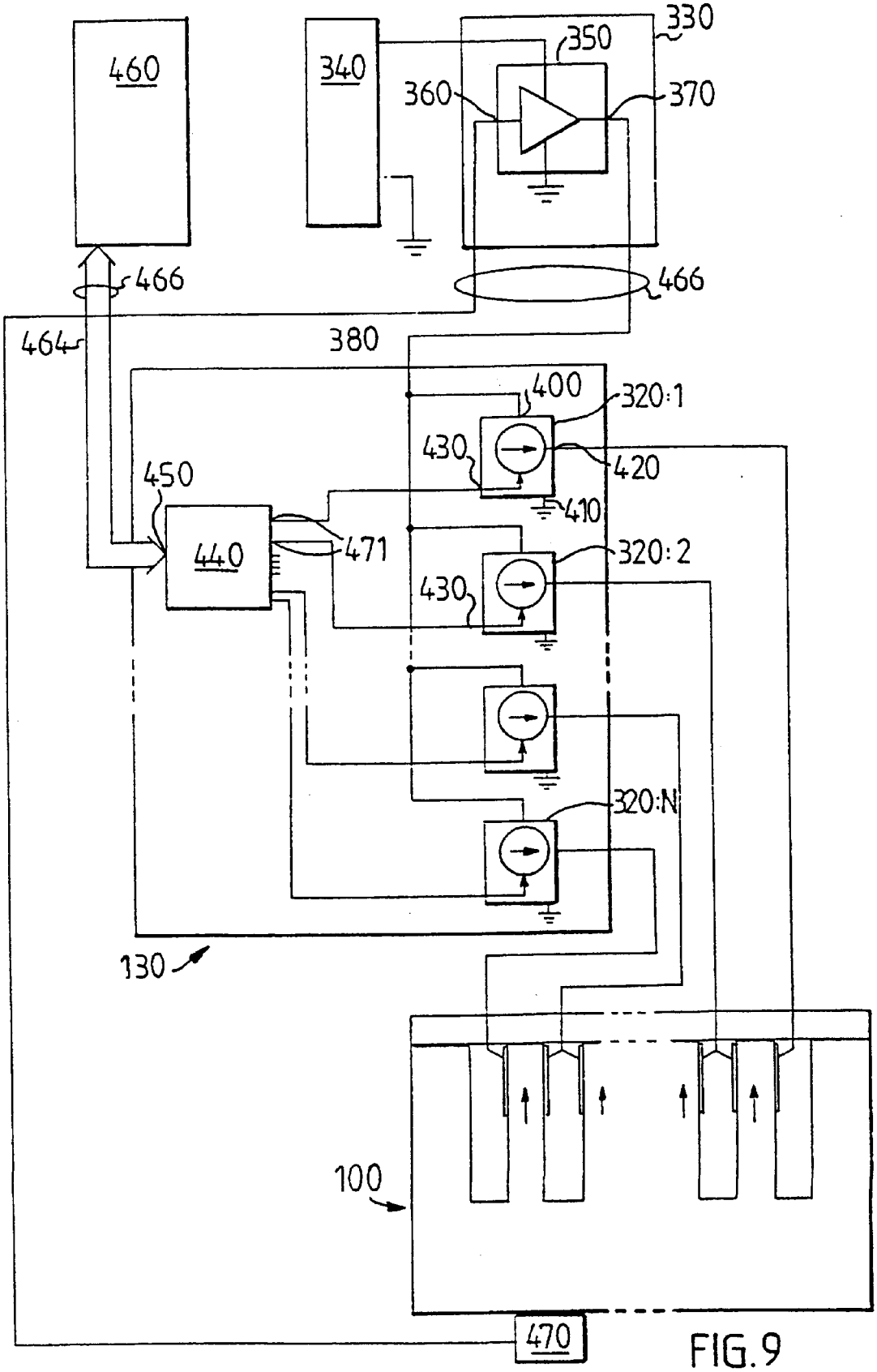
FIG. 9 is a block diagram of a printer arrangement including a control unit coupled to an actuator and to a power supply circuit, according to an embodiment of the invention.

FIG. 9 is a block diagram of an embodiment of the invention, comprising an actuator control circuit 130, a power supply circuit 330 and an actuator 100. The power supply circuit 330 is coupled to a DC power supply 340. The power supply 340 may for example provide a substantially constant voltage $V_{DC}$ of 40 volts. The power supply circuit 330 comprises a drive voltage controller 350, having an input 360 for a power demand signal and a power supply output 370 for delivering a drive voltage with a controlled voltage $V_{cc}$. The controlled voltage $V_{cc}$ may for example be controllable from 10% of $V_{cc(100)}$ to 100% of $V_{cc(100)}$, where $V_{cc(100)}$=35 volts.

The actuator control unit 130 comprises a power supply input 380 which is coupled to the output 370 for receiving a controlled drive voltage. The control unit 130 comprises a plurality, N, of controllable drive signal sources 320:1–320:N, each drive signal source having a drive voltage input 400 which is coupled to the power supply input 380. Each drive signal source has an earth connection 410 and an actuator drive signal output 420. Each actuator drive signal output is coupled to the electrodes E of a corresponding channel wall in the actuator 100. According to a preferred embodiment the drive signal sources 320 are current sources.

Each drive signal source 320 also comprises an input 430 for a current control signal. The current control signal input is coupled to a data conversion unit 440. The data conversion unit comprises an input 450 for receiving print data indicative of the text or picture to be printed. The input 450 is adapted to be connected to a data interface 460 via a databus 464. With reference to FIG. 1 a plurality of electrical conductors 466 are provided to connect the control unit 130 with the data interface 460 and the power supply circuit 330.

According to an embodiment of the invention, the actuator control circuit 130 and the actuator 100 are arranged on a movable shuttle in a printer, while the data interface 460 and the drive voltage controller 350 are stationary parts in the printer.

The data conversion unit 440 converts print data received on the input 450 into individual current control signals for each drive signal source 20. For this purpose the data conversion unit 440 comprises a control signal output 471 corresponding to each drive signal source 320, and hence a current control signal for each channel in the actuator.

The data conversion unit in co-operation with the controllable drive signal sources 320 operates to generate drive currents on the out puts 420 such that the wave forms of the drive signals delivered to each actuator wall causes a controlled movement of each wall.

The velocity of ink droplets as they leave the nozzle is critical. For high quality printing and high resolution printing, the ink velocity must be uniform for each channel. Deviations between the channels causes the dots of ink to be misaligned or merged, which leads to poor print out quality. The inventors realized that variations in channel dimensions during manufacture and non-uniform electrode thickness affect the velocity of ink droplets. In fact different walls 230 may provide different capacitance and different spring constants.

Additionally the metallisation process used for obtaining the electrodes E may affect the poling of the PZT-material. In this manner there may be deviations between one actuator and another such that the mean droplet velocity of one actuator differs from that of another actuator when subjected to the same electric drive pulse.

According to the invention these problems are addressed by controlling the shape of the drive pulses.

Figure 10:
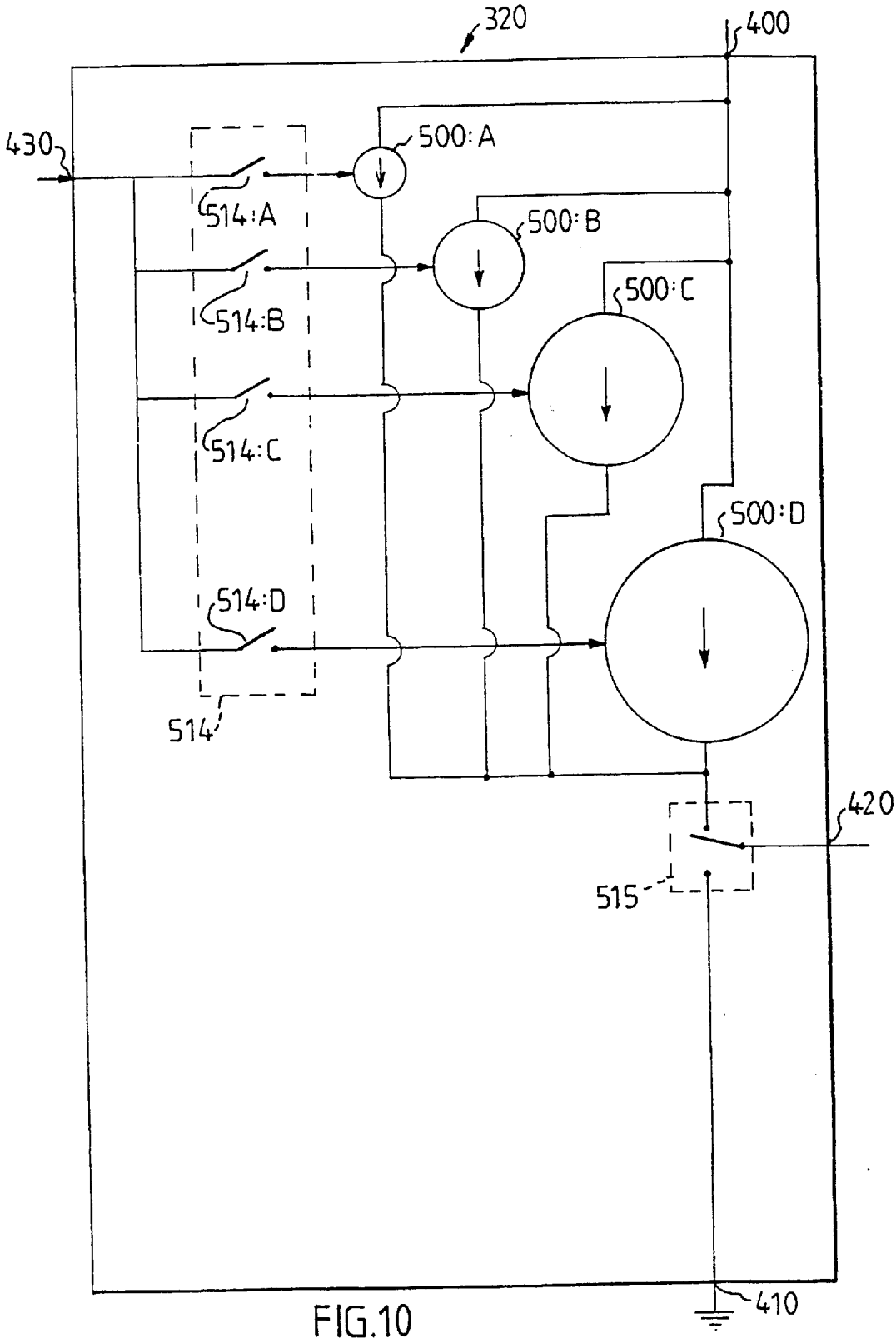
FIG. 10 is a block diagram of a controllable drive signal source, according to an embodiment of the invention.

FIG. 10 is a block diagram of a controllable drive signal source 320, according to an embodiment of the invention. Tests made by the inventors have shown that drop velocity depends on the slew rate of the drive signal shown in FIG. 8. In order to control the slew rate of the voltage pulse the drive signal source is constructed with four output current sources 500:A, 500:B, 500:C, 500:D. Current source 500:B provides twice the current of current source 500:A., current source 500:C provides twice the current of current source 500:B, and current source 500:D provides twice the current of current source 500:C. Hence. a current ratio 1:2:4:8 is obtained. The current sources 500 include output devices, wherein the geometric area of an output device is directly proportional to the current it can provide, thereby making slew rate control possible. According to an embodiment the output devices 500:A, 500:B 500:C, 500:D are integrated circuit MOS transistors.

The outputs of the current sources 500:A, 500:B, 500:C, 500:D are coupled to a switch 515 for connecting the driver output 420 to the outputs of the current sources 500:A, 500:B, 500:C, 500:D or to ground 410. According to an embodiment the driver stage 320 is push-pull connected; There being provided a number of current sources (not shown) between the switch 515 and ground 410 so as to enable control of the negative slope of the pulse signal delivered on output 420. These current sources are pulling current sources of values corresponding to current sources 500:A, 500:B, 500:C, 500:D, and these current sources are also controlled by the switch means 514. According to another version there is provided a separate switch for controlling the pulling current sources.

The voltage swing dV of the drive current on each output 420 depends on the voltage on the power supply input 400. The slew rate dV/dT depends on the total current and the capacitance of the channel:

$$dV/dT=I_{total}/C \tag{1}$$

where:

dV is the output voltage swing, dT is the time duration for driving the output between its limits;

C is the capacitive load of the actuator drive electrodes connected to the drive output 420;

$$I_{total}=n*I \tag{2}$$

I is the current from an output device of unit area.

n is the equivalent number of unit area modules.

From equations (1) and (2) it is deduced that the duration for a voltage swing from one limit value to the other limit value, can be expressed as:

$$dT=dV_{(10\text{-}90)}*C/(n*I)$$

where $dV_{(10\text{-}90)}$ is the voltage change between 10% and 90% of $V_{cc(100)}$.

The voltage swing dV of the drive current on each output 420 depends on the voltage $V_{cc}$ delivered on the power supply input 380, 400. As mentioned above, the actuator includes a temperature sensor 470 for the purpose of controlling the voltage $V_{cc}$, i.e. the voltage swing dV, so as to compensate for the temperature dependency of the viscosity of the ink. The temperature sensor 470 provides a temperature signal which indicates the power demand for driving the actuator with optimum performance. The power demand signal input 360 of the power supply circuit is adapted to receive the signal from the sensor 470, or a demand signal derived from the sensor 470.

A four bit binary control scheme is implemented by individually the activation of the four current sources 500:A, 500:B, 500:C and 500:D. A switch unit 514, having switches 514:A, 514:B, 514:C and 514:D controls the activation of the individual current sources 500:A, 500:B, 500:C and 500:D, respectively. According to one embodiment one of the current sources, e.g. the smallest current source 500:A, will always be active, whilst the remaining three current sources may be controlled by switches of a switch unit 514. In such an embodiment the switch unit may be reduced to include three switches.

According to one embodiment the switch unit 514 is a write-once memory, e.g. a fusible link memory. According to a preferred embodiment there is provided one switch unit for all N drive signal sources 320:1–320:N. Hence a fusible link memory of 3*N bits may be used for providing individual settings of the channels in the actuator.

Figure 11:
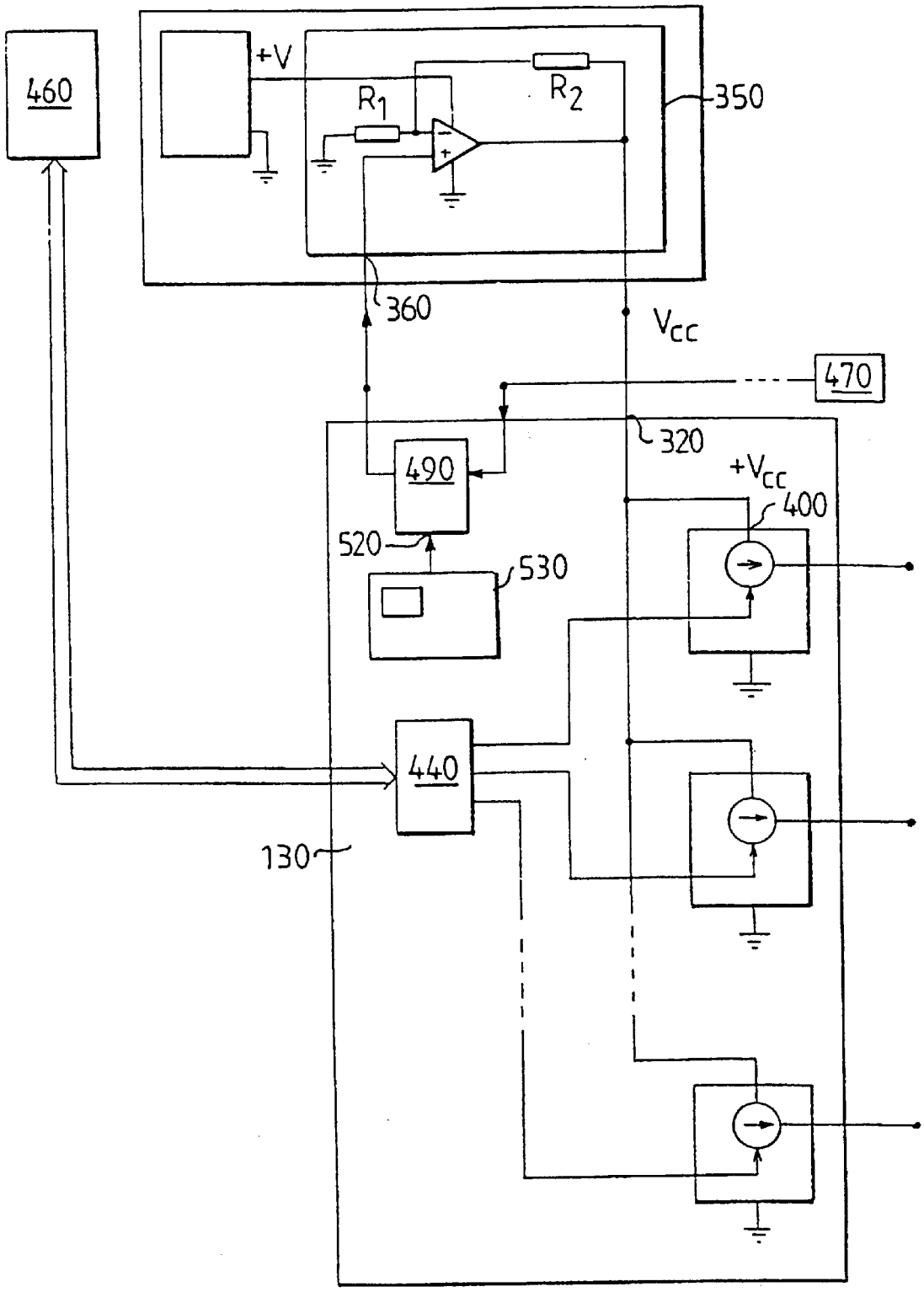
FIG. 11 is a block diagram of a printer arrangement including a control unit coupled to a power supply circuit and for connection to an actuator, according to another embodiment of the invention.

According to one embodiment of the invention the power demand signal delivered to the input 360 is derived from the signal from sensor 470 in combination with other performance affecting variables. The embodiment according to FIG. 11 differs from the embodiment according to FIG. 9 in that the sensor 470 is coupled to an evaluation circuit 490, which operates to generate a voltage demand signal in dependence on sensed temperature. The output of the evaluation circuit 490 is coupled to the input 360 of the power supply circuit 350.

According to one embodiment of the invention the evaluation circuit 490 comprises an input 520 for receiving additional data relating to the performance affecting variables such as for example actuator efficiency and/or type of liquid. Such data includes for example data defining the temperature dependency of the liquid to be ejected by the actuator. The evaluation circuit 490 is, according to a preferred embodiment, integrated with the control unit 130.

The additional data relating to performance of the actuator 100 are generated by an actuator status circuit 530. The actuator status circuit, also integrated in the control unit 130, includes a memory for storing data derived from measurements of the performance of the individual actuator control unit combination.

According to the invention the process of manufacturing droplet deposition apparatuses includes assembling an actuator 100 and a control unit 130 including drivers 320 having a writeable memory 514. This droplet deposition apparatus is subjected to a test including establishing the drop velocity for each channel and the mean drop velocity for the droplet deposition apparatus using standard drive pulses. Thereafter the average drop velocity is adjusted to an advantageous level by setting control data in the actuator status circuit 530 so as to increase or decease the mean velocity. This may be obtained by adjusting the value of the 100% voltage level $V_{cc(100)}$. For one adjusted droplet deposition apparatus the voltage level $V_{cc(100)}$ may equal 32 volts, and for another one the voltage level $V_{cc(100)}$ may equal 34 volts, for example.

Thereafter the individual channels of the droplet deposition apparatus are adjusted to a uniform droplet speed level by activation of an appropriate combination of switches 514A, 514B, 514C and 514D for each driver 320. Setting the current level leads to setting an appropriate slope of the drive pulse, thereby adjusting the droplet speed for the channel associated with that driver 320. In this manner an increased proportion of actuators obtain high print quality, since deviations in the manufacture process can be effectively compensated in a cost effective manner.

According to one version of the invention the memory 514 for controlling all the drivers 320 is integrated in the actuator status circuit, such that all compensation and adjustment data can be written into one single memory.

Figure 12:
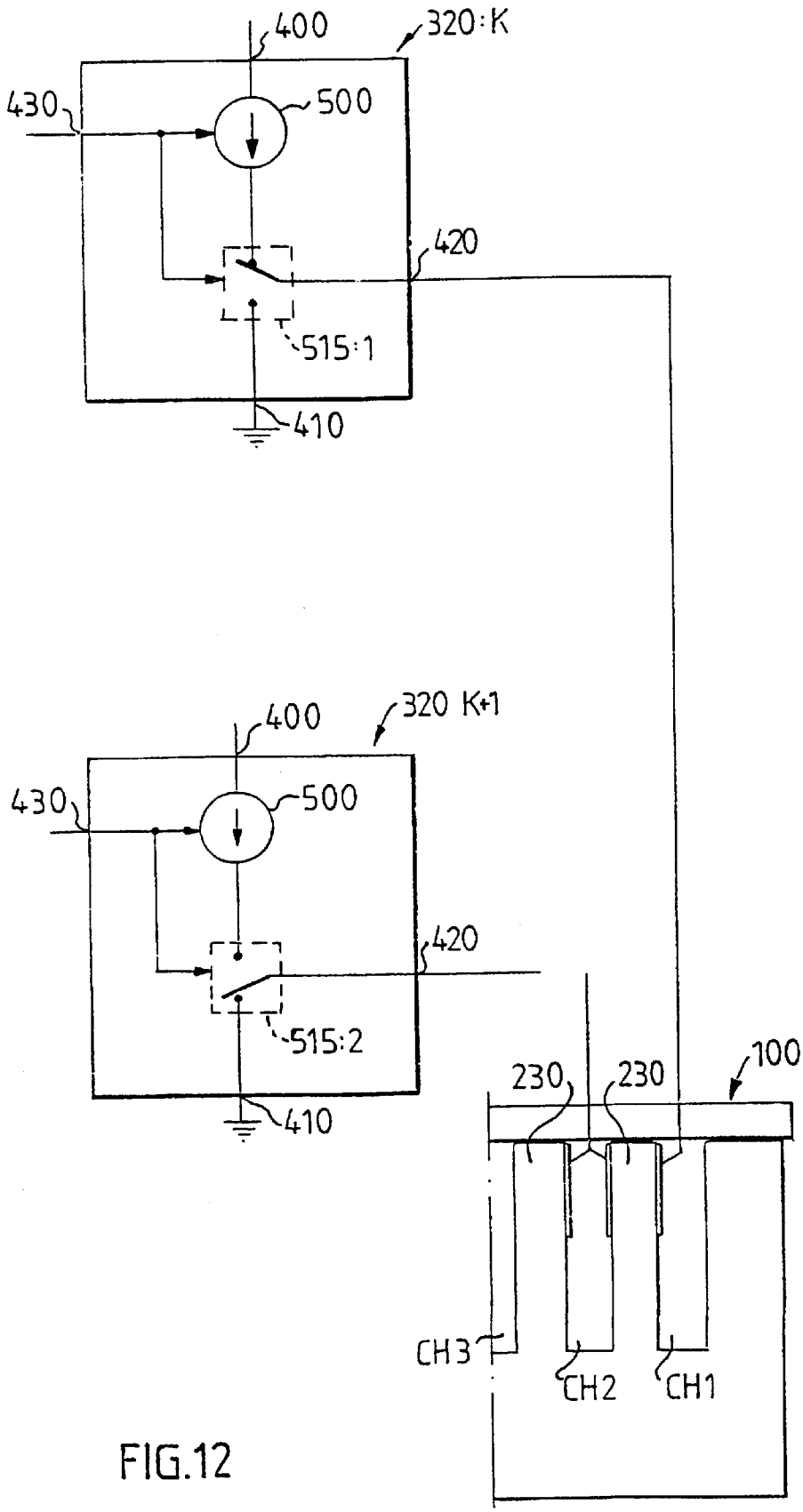
FIG. 12 is a block diagram of a controllable drive signal source, according to another embodiment of the invention.

FIG. 12 is a block diagram illustrating another embodiment of the controllable current signal source 320, shown in FIG. 9. FIG. 12 also shows how two current sources 320:k and 320:k+1 co-operate to provide a push-pull drive signal, as illustrated in FIG. 8, to an actuator wall 230 between channels CHk and CHk+1. Hence, each actuator wall is connected to two individually controlled current sources 320:k and 320:k+1. As indicated by FIGS. 8, 9 and 12 an actuator wall is connected so as to receive a push-pull signal from one pair of current sources 320:k and 320:k+1 whereas other walls receive push-pull signals from other pairs of current sources 320:j and 320:j+*1;* where k and j are positive integers, and j never equals k. In other words a first actuator wall is coupled to receive a drive signal from a first pair of push-pull connected signal sources and a second actuator wall is coupled to receive a drive signal from a second pair of push-pull connected signal sources, where the second pair is different from the first pair.

According to embodiments of the invention there is provided a plurality of current sources 320, each such current source 320 being connected to at least one actuator wall. In this manner an improved print quality is enabled. This advantageous effect is obtained since control of the deflection of each wall is enabled by controlling the current delivered to it. In the embodiment shown in FIG. 9 there is provided one current source 320 for each actuator channel, and the current through one wall is determined by the current sources connected to electrodes in the channels bordering that wall.

A current signal source 320 comprises a current source 500 receiving a drive voltage from the drive voltage input 400, and a control signal from the control signal input 430. The output of the current source 500 is coupled to a switch 515 for connecting the driver output 420 either to the output of the current source 500 or to ground 410. The switch 515 is also controlled by the signal from the control signal input 430. FIG. 12 illustrates a switch setting when current source 320:1 can drive a current via switch 515:1 through the wail between channels CH1 and CH2 and via switch 515:2 to ground.

Figure 5C:
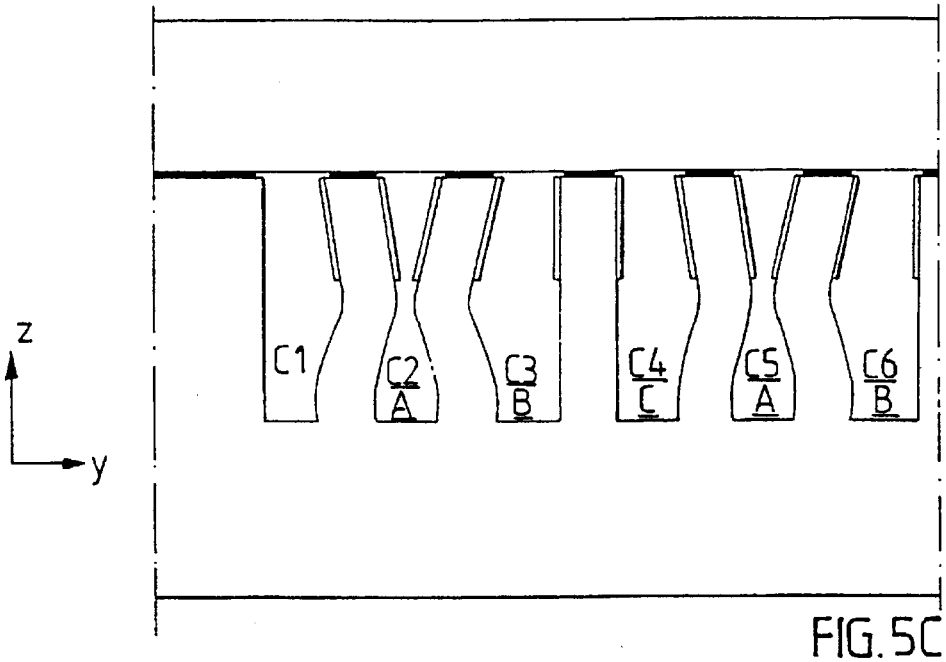
FIG. 5C is a cross-section of apart of the actuator shown in FIGS. 1 and 2 with some channels shown in a contracted state.
Figure 13:
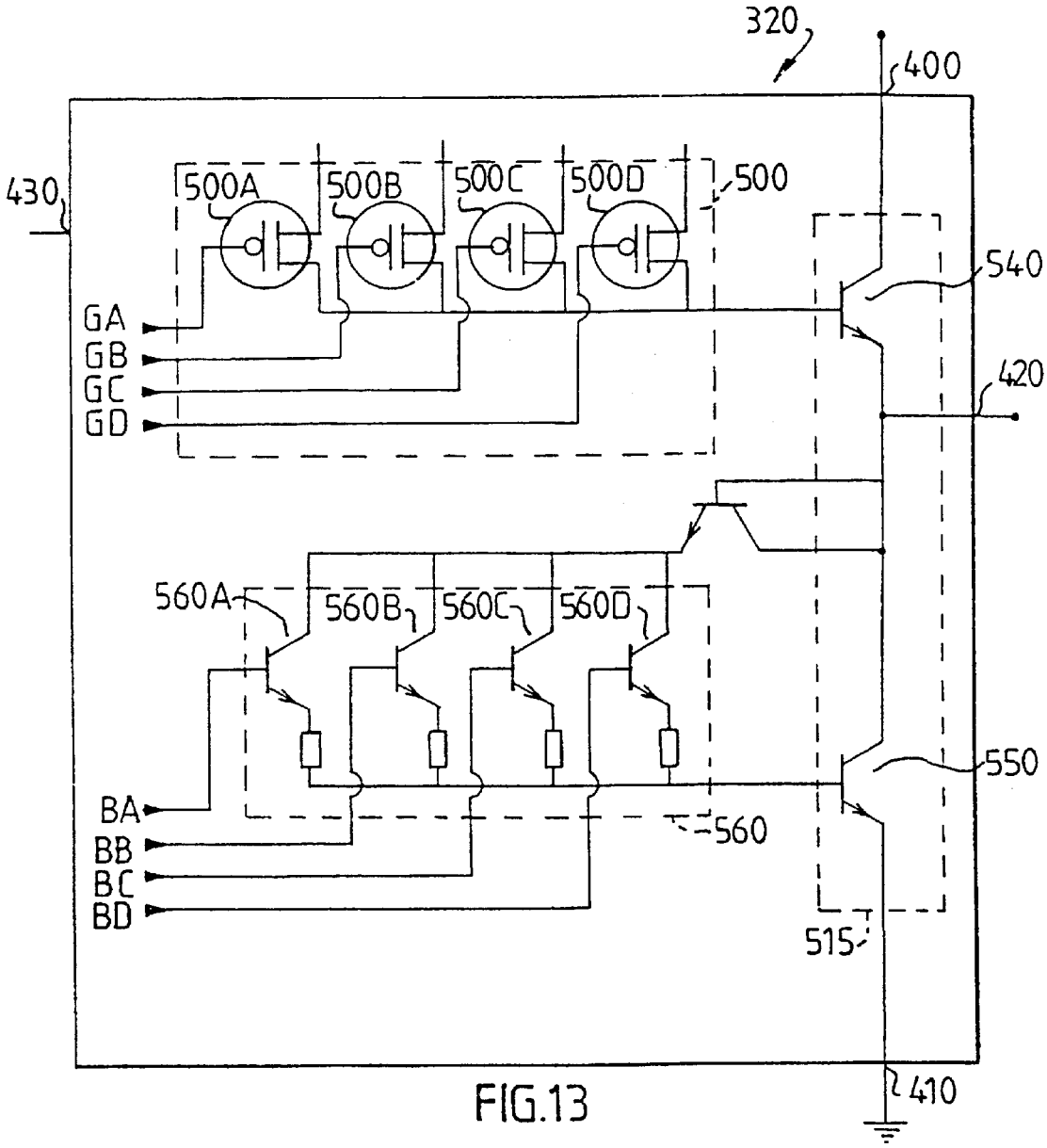
FIG. 13 is a schematic of an embodiment of a controllable drive signal source.

FIG. 13 is a schematic of an embodiment of a controllable drive signal source 320. Each of the N actuator channels has a non-inverting drive signal source 320. The actuator load appears as a large capacitor and parallel resistor strung between each neighbouring driver output. The dielectric of these capacitors is formed by the piezoelectric material in the wall 230 (FIG. 2). In order to draw in liquid in the k:th channel the driver 320:k drives the output 420:k to the positive rail, whilst the outputs 420:k−1 and 420:k+1 of the neighbouring neighbouring channels ($C_{k-1}$ and $C_{k+1}$) are held at the negative rail. This charges the two capacitors of the walls of channel $C_k$. During the droplet ejection stage, a reverse polarity pulse is applied, see FIGS. 5, 7 and 8, reversing the charge polarity of the wall capacitor. Again, this deflects the channel walls so as tocontract the channel (FIG. 5C). Finally, during a recovery stage the potential across the wall 230 is restored to zero as the wall capacitance is discharged to their initial state.

With reference to FIG. 13 there is provided a two output bipolar NPN-transistors 540 and 550 forming the switch 515. A number of MOS transistors form the current sources 500:A, 500:B, 500:C and 500:D, as described above for driving the output 420 to the positive. In a similar manner a number of NPN-transistors 560A, 560B, 560C, and 560D act as current sources 560 for driving the output 420 to the negative rail. The output drive capacity of the output bipolar NPN-transistors 540 and 550 is determined by the MOS transistors 500:A, 500:B, 500:C, 500:D and by the NPN-transistors 560A, 560B, 560C, and 560D. The MOS transistors 500 and the NPN-transistors 560 limit the available base current for the NPN-transistors 540 and 550, thereby determining the slew rate when switching these devices in a controlled manner. The output state is determined by the signals GA, GB, GC, GD, BA, BB, BC and BD which are related to the signal on input 430, as described above. With reference to FIG. 10 and the associated description, a switch 514, e.g. in the form of a fusible link memory, may be provided between the input 430 and the terminals GA, GB, GC, GD, BA, BB, BC and BD.

What is claimed is:

1. A droplet deposition apparatus comprising:

an actuator having a plurality of spaced piezoelectric walls defining channels, said walls having opposed sides, said opposed sides being provided with electrodes being adapted to receive electric drive signals to deform said walls to cause liquid in said channels to be ejected therefrom, said drive signals having waveforms; and a control unit comprising a power supply input for receiving a temperature dependent drive voltage for controlling the magnitude of the drive signals applied to each of the electrodes of the actuator, and control means comprising a plurality of drive signal sources for receiving said drive voltage, each drive signal source comprising:

an input for receiving a current control signal;

at least two current sources, each being selectively activatable in response to the current control signal for receiving said drive voltage and outputting a drive signal having a waveform of respective linear slope; and a drive signal output for supplying the drive signal to at least a selected one of said electrodes.

2. The droplet deposition apparatus according to claim 1, wherein said control means includes means for setting compensation data so as to adapt the slope of the waveform for an individual channel deviation.

3. The droplet deposition apparatus according to claim 2, wherein said means for setting compensation data includes a switch unit having switches controlling the activation of individual current sources.

4. The droplet deposition apparatus according to claim 1, comprising means for setting a selected uniform droplet velocity of ejected droplets.

5. The droplet deposition apparatus according to claim 4, wherein said means for setting uniform droplet velocity includes a power supply circuit comprising a drive voltage controller having an input for a power demand signal and a power supply output for delivering said drive voltage.

6. A control circuit for an actuator having a plurality of spaced piezoelectric walls defining channels, said walls having opposed sides, said opposed sides being provided with electrodes being adapted to receive electric drive signals to deform said walls to cause liquid in said channels to be ejected therefrom, said drive signals having waveforms, the control circuit comprising:

a power supply input for receiving a temperature dependent drive voltage for controlling the magnitude of the drive signals applied to each of the electrodes of the actuator, and a plurality of drive signal sources for receiving said drive voltage, each drive signal source comprising:

an input for receiving a current control signal;

at least two current sources, each being selectively activatable in response to the current control signal for receiving said drive voltage and outputting a drive signal having a waveform of respective linear slope; and a drive signal output for supplying the drive signal to at least a selected one of said electrodes.

7. The control circuit according to claim 6, wherein a geometric area of a current source is substantially proportional to the current produced by the current source.

8. The control circuit according to claim 6, wherein the current capacities of the current sources connected to one drive signal output are mutually different.

9. A method of obtaining a uniform drop ejection speed for a droplet deposition apparatus having a plurality of channels with ejection nozzles, the method comprising:

measuring a drop velocity for droplets ejected from a number of nozzles corresponding to the selected channels;

adjusting an average drop velocity by at least one of increasing and decreasing a voltage level delivered to the selected channels; and adjusting individual drop velocities by setting individually adapted current levels for each channel in dependence on the measured velocities.

* * * * *